US008884151B1

(12) United States Patent
Lee

(10) Patent No.: US 8,884,151 B1
(45) Date of Patent: Nov. 11, 2014

(54) ELECTRONIC DRUM PAD

(71) Applicant: Chun-Ming Lee, Taipei (TW)

(72) Inventor: Chun-Ming Lee, Taipei (TW)

( * ) Notice: Subject to any disclaimer, the term of this patent is extended or adjusted under 35 U.S.C. 154(b) by 0 days.

(21) Appl. No.: 14/302,878

(22) Filed: Jun. 12, 2014

(30) Foreign Application Priority Data

Jun. 13, 2013 (TW) ..... 102211018 A

(51) Int. Cl.

| | |
|---|---|
| ***G10H 1/32*** | (2006.01) |
| ***G10H 3/00*** | (2006.01) |
| ***A63J 17/00*** | (2006.01) |
| ***A63J 5/10*** | (2006.01) |
| ***G10H 1/00*** | (2006.01) |
| ***G10H 3/14*** | (2006.01) |
| ***G10D 13/02*** | (2006.01) |

(52) U.S. Cl.
CPC ..... *G10H 3/146* (2013.01); *G10D 13/024* (2013.01)
USPC ..... 84/743; 84/464 R

(58) Field of Classification Search
USPC ..... 84/723, 743, 464 R, 464 A
See application file for complete search history.

(56) References Cited

U.S. PATENT DOCUMENTS

| | | | | |
|---|---|---|---|---|
| 4,570,522 | A * | 2/1986 | May | 84/723 |
| 4,648,302 | A * | 3/1987 | Bozzio | 84/730 |
| 5,583,307 | A * | 12/1996 | Tobia, Jr. | 84/411 R |
| 6,031,176 | A * | 2/2000 | Tanaka | 84/735 |
| 7,179,985 | B2 * | 2/2007 | Pickens | 84/743 |
| 7,282,633 | B1 * | 10/2007 | Coolidge | 84/723 |
| 7,396,991 | B2 * | 7/2008 | Susami | 84/615 |
| 7,488,887 | B2 * | 2/2009 | Mori | 84/743 |
| 8,039,724 | B1 * | 10/2011 | Norman et al. | 84/743 |
| 8,173,886 | B2 * | 5/2012 | Hashimoto | 84/723 |
| 8,563,843 | B1 * | 10/2013 | Shemesh | 84/743 |
| 2004/0025663 | A1 * | 2/2004 | Harada et al. | 84/104 |
| 2005/0150366 | A1 * | 7/2005 | Susami | 84/735 |
| 2013/0098227 | A1 * | 4/2013 | Wei | 84/723 |
| 2013/0112068 | A1 * | 5/2013 | Rogers | 84/723 |

* cited by examiner

*Primary Examiner* — Jeffrey Donels
(74) *Attorney, Agent, or Firm* — Muncy, Geissler, Olds & Lowe, P.C.

(57) ABSTRACT

The present disclosure illustrates an electronic drum pad comprising: a base body having a frame rim protruding upwardly at an edge part of an upper surface thereof, and having a frame dike protruding downwardly at an edge part of a lower surface thereof, and the frame dike buckled and fastened on a drum frame of a jazz drum; a striking region portion arranged in a center of the base body; a first trigger configured for sensing the vibration of the striking region portion, arranged inside a first electronic component groove of the base body, and located in a bottom part of the striking region portion; a second trigger configured for sensing the vibration of the frame rim, arranged inside a second electronic component groove of the base body, and the second electronic component groove being close to the frame rim.

17 Claims, 6 Drawing Sheets

ELECTRONIC DRUM PAD

CROSS-REFERENCE TO RELATED APPLICATION

This application claims the benefit of Taiwan Patent Application No. 102211018, filed on Jun. 13, 2013, in the Taiwan Intellectual Property Office, the disclosure of which is incorporated herein in its entirety by reference.

BACKGROUND OF THE INVENTION

1. Field of the Invention

The present disclosure relates to a percussion instrument, more particularly to a drum. The present disclosure provides an electronic drum pad which can be combined on the drum frame of the jazz drum, whereby the jazz drum can be changed to an electronic drum.

2. Description of the Related Art

A jazz drum, also known as drum kit, is set of combination of the hand hit instruments and the foot hit instruments having with different types and different tones, and can be applied to a variety of music types. An electronic drum is a percussion instrument using an electronic synthesizer to produce drumbeats, and includes two parts of the electronic synthesizers and a striking region portion. The electronic drum looks like the jazz drum in appearance, but has relatively smaller size and smaller drumhead.

Based on the diversification in types of music and performance, many drummers must be familiar with both of jazz drum and electronic drum. However, it is very space-consuming while both of the jazz drum and the electronic drum are placed in the performance occasions or practice environments at the same time. In addition, the positions and heights of the large jazz drum, medium jazz drum, snare jazz drum and cymbal are different from the electronic drum, so the drummer who is familiar to the jazz drum already also must spend time for re-adapting to the positions and heights of the electronic drums for re-training feel. Therefore, if the jazz drums can be converted into the electronic drums directly, the problem of re-adaption for drummers can be solved and the space is prevented from being occupied by two sets of drums.

SUMMARY OF THE INVENTION

The problem to be solved in this disclosure is how to convert a jazz drum to an electronic drum. An aspect of the embodiment of the present disclosure is to provide an electronic drum pad which can be combined on a jazz drum to convert the jazz drum to an electronic drum. The electronic drum pad comprises: a base body having a frame rim protruding upwardly at an edge part of an upper surface thereof and a frame dike protruding downwardly at an edge part of a lower surface thereof; a striking region portion arranged in a center of the base body; a first trigger configured for sensing the vibration of the striking region portion, arranged inside a first electronic component groove of the base body, and located in a bottom part of the striking region portion; a second trigger configured for sensing the vibration of the frame rim, arranged inside a second electronic component groove of the base body, and the second electronic component groove being close to the frame rim.

The base body can be combined the drum frame of a jazz drum by the frame dike, the lower surface of the base body and a drum skin of the jazz drum are spaced from a distance. When a drum stick knocks the striking region portion or the frame rim, the first trigger senses the vibration of the striking region portion, and the second trigger senses the vibration of the frame rim. The first trigger and the second trigger output a vibration signal to a trigger module. The trigger module then transforms the vibration signal into a simulated drum head sound or simulated drum frame sound, and the simulated sounds are outputted via a sound box or earphones.

The materials of the base body and the striking region portion are selected from rubber or silica gel.

The base body has at least one decorative groove at the upper surface thereof outside against the striking region portion. An LED lighting unit set and a circuit unit related to the LED lighting unit set are embedded in the decorative groove, and the circuit unit is coupled with the first trigger.

The present disclosure has at least one of the following advantages.

The electronic drum pad can be mounted on the drum frame of the jazz drum directly to replace the drum skin of the jazz drum, whereby the jazz drum can be converted to an electronic drum.

The electronic drum pad can be mounted on the drum frame of the jazz drum directly, and can be combined on the drum frame of the jazz drum, be replaced or disassemble from the drum frame of the jazz drum without using tool, screw or bolt element, so it is convenient and quick to stably combine the electronic drum pad with the drum frame of the jazz drum.

The base body of the electronic drum pad is mounted on the outer edge of the drum frame of the jazz drum via the peripheral of the frame dike of bottom portion of the base body, so the base body can be made in various sizes to fit the drum frame of the jazz drum with various sizes.

The electronic drum pad is added with a LED lighting unit set, the circuit board of the LED lighting unit set is coupled to the first trigger and the second trigger, so the LED lighting unit set can flicker according to the preset program of the circuit board and the preset signal while the striking region portion or the frame rim is knocked.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
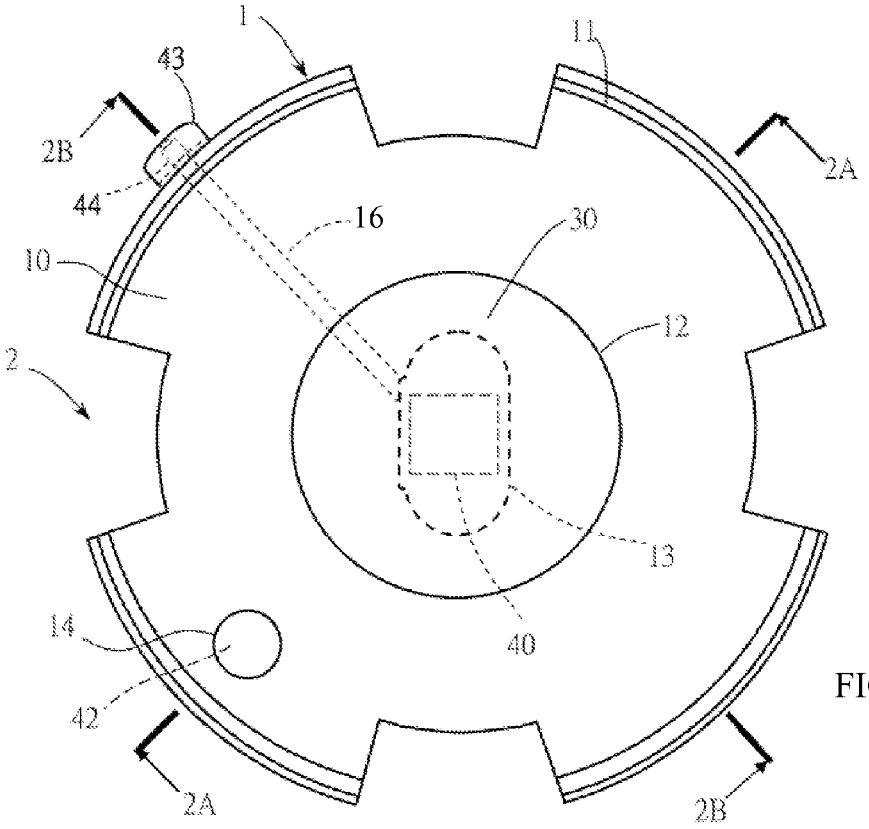
FIG. 1 is a top plan view of a first embodiment of an electronic drum pad of the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Figure 2A:
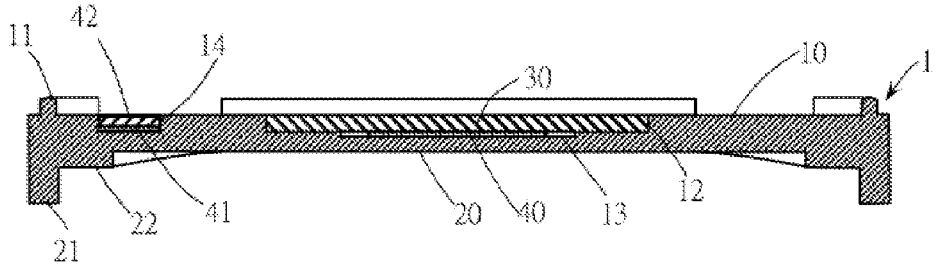
FIG. 2A is a section view of the FIG. 1 along a line 2A-2A.
Figure 2B:
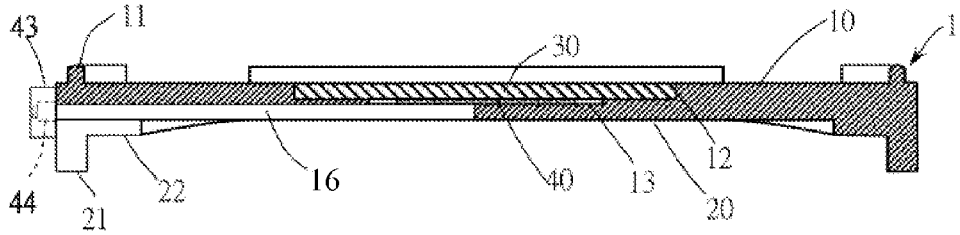
FIG. 2B is a section view of the FIG. 1 along a line 2B-2B.

Please refer to FIG. 1, FIG. 2A and FIG. 2B, the electronic drum pad of the present disclosure is a structure formed integrally, and has a base body 1 which has multiple portions 2 without board material at the edge part thereof for reducing weight. The base body 1 has an upper surface 10 and a lower surface 20. A frame rim 11 protruding upwardly is formed at the edge part of the upper surface 10, a central recess 12 is formed at the center of the upper surface 10, and a first electronic component groove 13 is formed at the bottom of the central recess 12; a second electronic component groove 14 is formed on the upper surface 10 and close to the frame rim 11. A frame dike 21 protruding downwardly is formed at the edge part of the lower surface 20, and a reinforcing structure 22 is formed at a corner between the frame dike 21 and the lower surface 20. The base body 1 is integrally formed by the rubber or the silica gel material.

A striking region portion 30 is located at the central recess 12 of the base body 1, and the central recess 12 is filled with the striking region portion 30, a surface of the striking region portion 30 flushes with the upper surface 10 of the base body 1. The striking region portion 30 is made of elastic material comprising rubber or silica gel, but the present disclosure is not limited thereto.

A first trigger 40 configured for sensing the striking region portion 30 is disposed in the first electronic component groove 13, a second trigger 41 for sensing the frame rim 11 is disposed in the second electronic component groove 14. The second trigger 41 is sealed by a sealing member 42 thereon, and the sealing member 42 is made of rubber or silica gel material, so that the second electronic component groove 14 is filled, and a surface of the second electronic component groove 14 flushes with the upper surface 10 of the base body 1. When the drum stick knocks the striking region portion 30 or the frame rim 11, the first trigger 40 senses the vibration of the striking region portion 30, and the second trigger 41 senses the vibration of the frame rim 11.

As shown in FIG. 1 and FIG. 2B, a socket box 43 is fastened at the side edge of the base body 1 by screws (not shown in FIGs). A socket 44 and a circuit board (not shown in FIGs) for signal stabilization are disposed in the socket box 43. The base body 1 has a wireway slot 16 at the lower surface 20 thereof, and circuits of the first trigger 40 and the second trigger 41 are connected to the socket 44 via the wireway slot 16. The first trigger 40 and the second trigger 41 output the vibration signal to a trigger module (not shown in FIGs) via the socket 44 and a signal wire (not shown in FIGs) connected thereto. The trigger module transforms the signal into a simulated drum head sound or drum frame sound, and the simulated sounds are outputted by a sound box or earphones.

Figure 3:
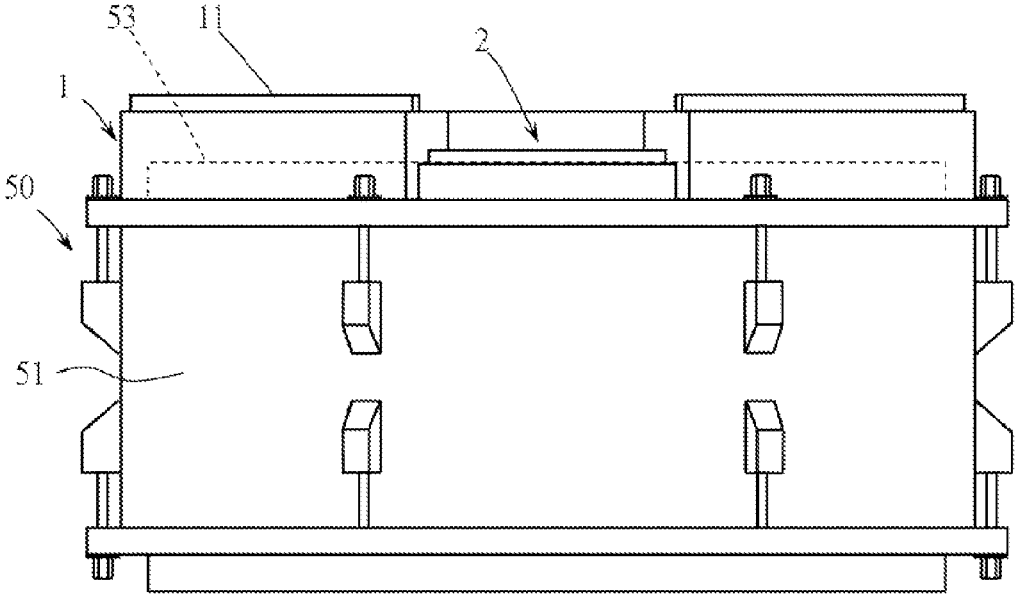
FIG. 3 is a lateral view of the electronic drum pad of the first embodiment of the present disclosure combining with a jazz drum.
Figure 4:
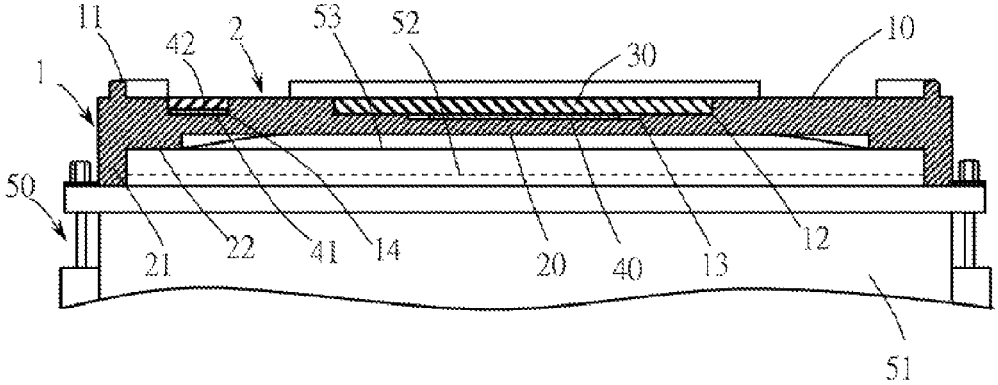
FIG. 4 is a schematic view of the electronic drum pad of the first embodiment of the present disclosure combining with a drum frame of the jazz drum.

As shown in FIG. 3 and FIG. 4, the electronic drum pad is combined with a jazz drum 50 for use. The jazz drum 50 is a known structure, so the detail description is omitted. The jazz drum 50 mainly comprises a cylindrical bulging 51, and a drum frame 53 combined with two ends of the bulging 51 to tense a drum skin 52. The electronic drum pad of the present disclosure is combined on the drum frame 53 by using the frame dike 21 to frame outside of the drum frame 53, the inner wall of the frame dike 21 contacts the outer wall of the drum frame 53. The jazz drum 50 can generally be a bass drum, a tenor drum, a snare drum, or a barrel drum, so the diameter of the electronic drum pad of the present disclosure is also made substantially according to the diameter of the bass drum, the tenor drum, the snare drum, or the drum, and the inner diameter of the frame dike 21 corresponds to the outer diameter of the bass drum, the tenor drum, or the snare drum. Therefore, the electronic drum pad of the present disclosure can fit with various sizes of the drum, and the electronic drum pad can be combined on the drum frame 53 stably by the frame dike 21 whose diameter fits the drum frame 53.

while the electronic drum pad is combined on the drum frame 53, the lower surface of the electronic drum pad is spaced from the drum skin 52 of the jazz drum 50 by an interval, so when the drum stick knocks the striking region portion 30 or the frame rim 11, the drum skin 52 of the jazz drum 50 does not vibrate.

When the electronic drum pad is combined on the jazz drum, the jazz drum is converted to an electronic drum. A drummer can use the drum stick to knock the striking region portion 30 or the frame rim 11, the first trigger 40 and the second trigger 41 can sense the vibration of the striking region portion 30 and the frame rim 11, respectively. The vibration signal is transmitted to the trigger module for being transformed to the simulated drum head sound or drum frame sound, and the simulated sounds are outputted by the sound box or the earphones.

Figure 5:
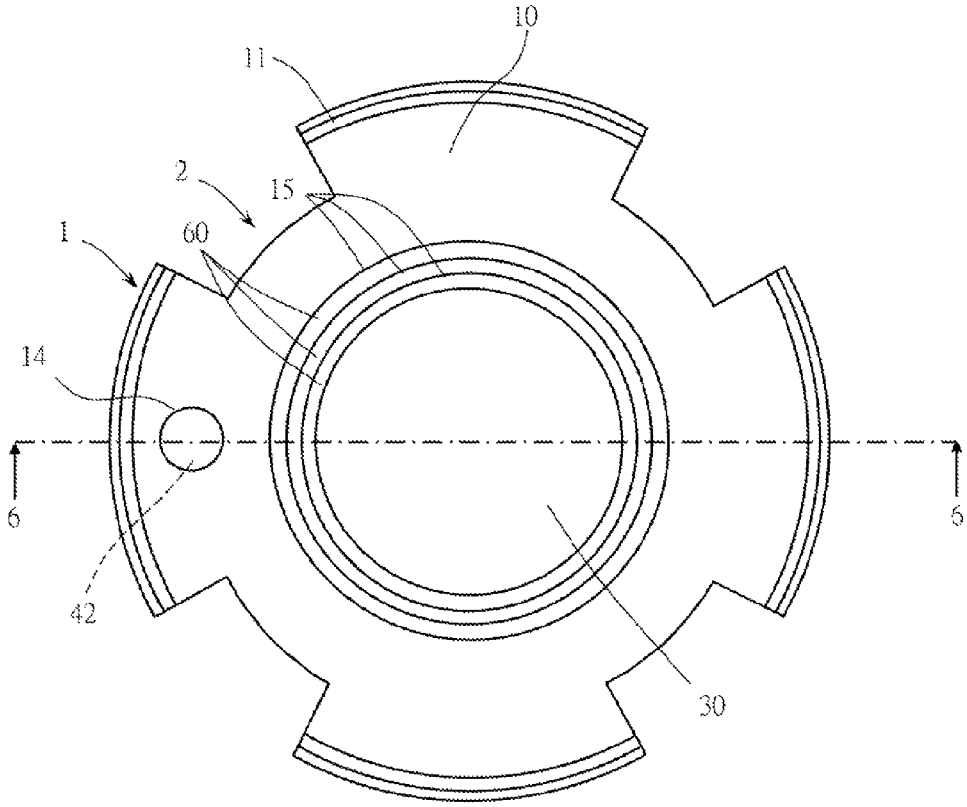
FIG. 5 is a top plan view of a second embodiment of the electronic drum pad of the present disclosure.
Figure 6:
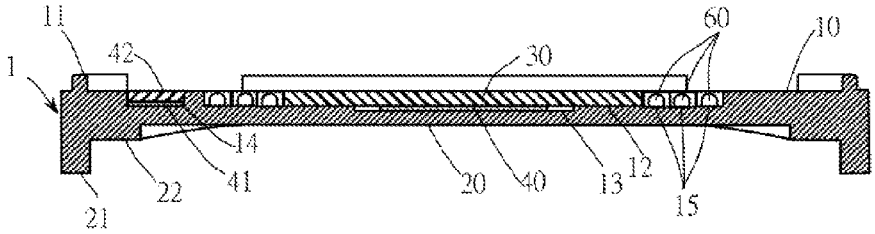
FIG. 6 is a section view of the FIG. 5 along a line 6-6.
Figure 7:
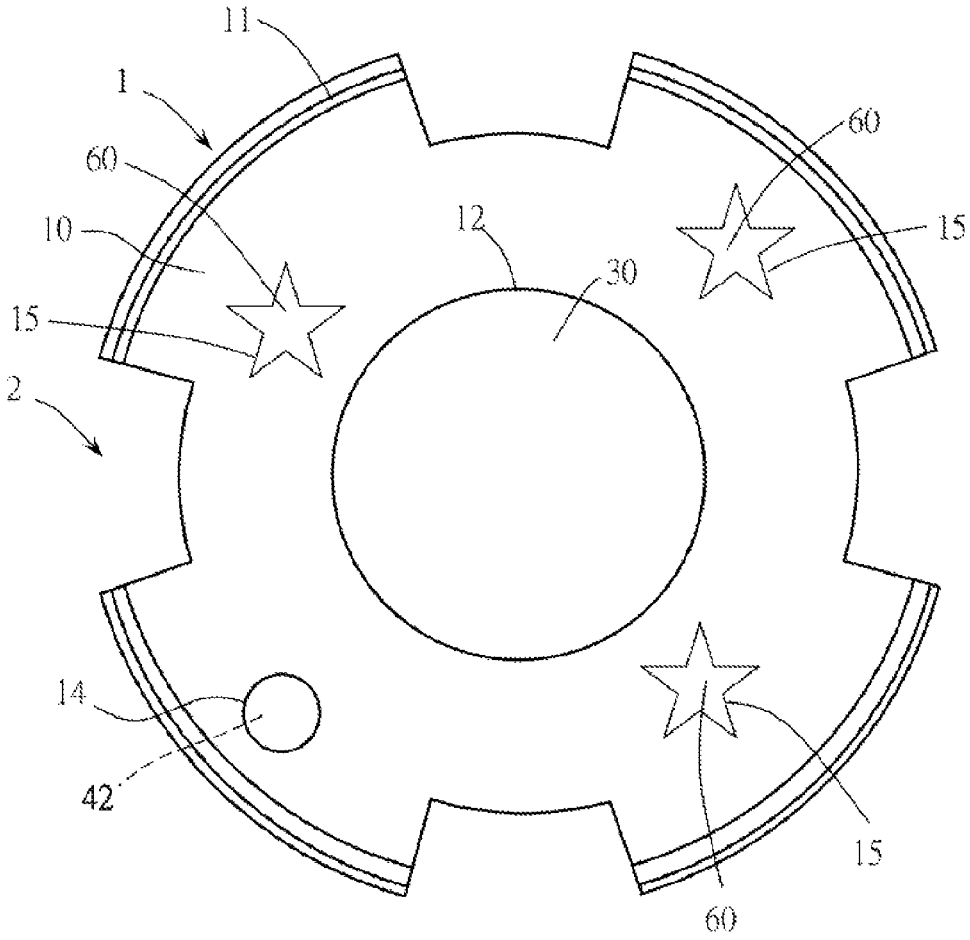
FIG. 7 is a top plan view of a third embodiment of the electronic drum pad of the present disclosure.

Please refer to FIG. 5, FIG. 6 and FIG. 7 which show a second embodiment and a third embodiment, at least one decorative groove 15 can be formed on the upper surface 11 of the base body 1 outside against the striking region portion 30. The decorative groove 15 can be in a single annular shape as shown in FIGs, or concentric annular shapes, or other geometric shape. A LED lighting unit set 60 and a circuit unit (not shown in FIGs) thereof are disposed within the decorative groove 15, and the circuit unit is coupled with the first trigger 40. When the first trigger 40 senses the vibration, the LED lighting unit set 60 lights or flickers at the same time.

Figure 8:
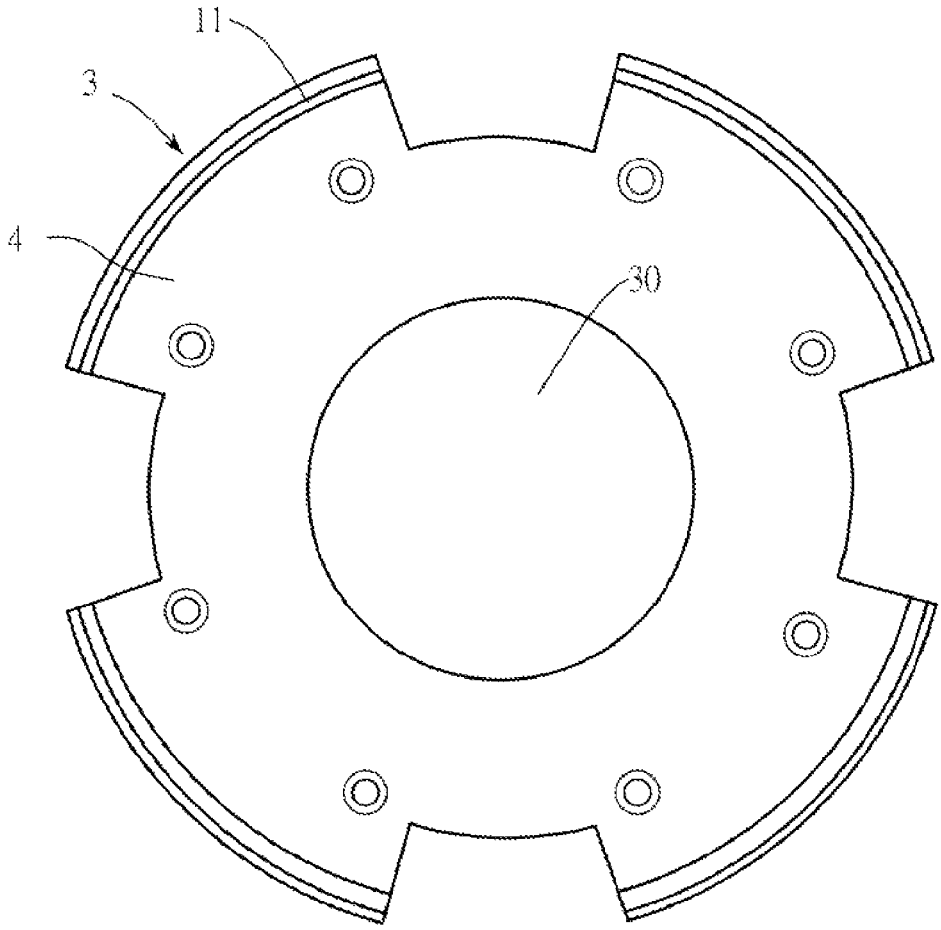
FIG. 8 is a top plan view of a first body member of a fourth embodiment of the electronic drum pad of the present disclosure.
Figure 9:
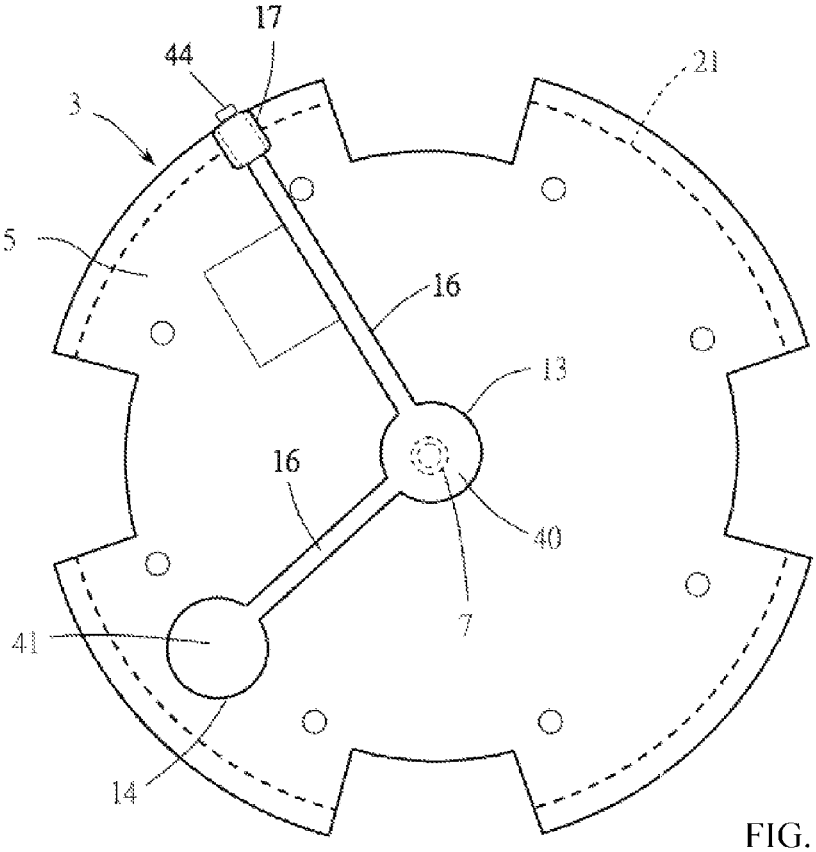
FIG. 9 is a top plan view of a second body member of the fourth embodiment of the electronic drum pad of the present disclosure.
Figure 10:
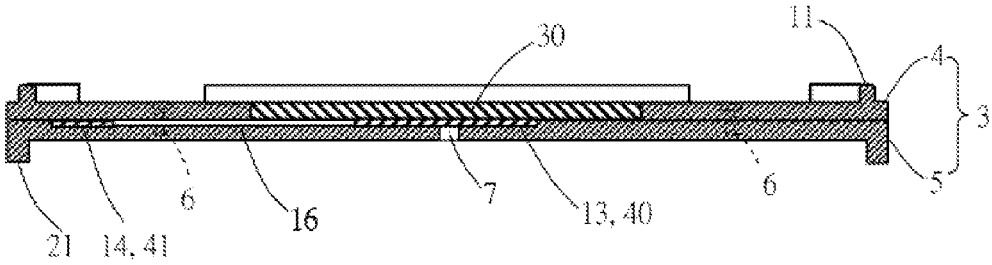
FIG. 10 is a combination section view of the fourth embodiment of the electronic drum pad of the present disclosure.

Please refer to FIG. 8, FIG. 9 and FIG. 10 which show the fourth embodiment of the electronic drum pad of the present disclosure, the base body 3 of the electronic drum pad is formed by combining a first body member 4 and a second body member 5 with a plurality of screws 6.

A striking region portion 30 is disposed at the center of the first body member 4. The striking region portion 30 is made of elastic material comprising rubber or silica gel, but the present disclosure is not limited thereto. The frame rim 11 protruding upwardly is formed on an edge part of an upper surface of the first body member 4.

A first electronic component groove 13 is formed at the center of the upper surface of the second body member 5, and a second electronic component groove 14, a socket groove 17 and a wireway slot 16 are formed close to the edge part of the second body member 5. A frame dike 21 protruding downwardly is formed at the edge part of the lower surface of the second body member 5. A first trigger 40 for sensing the striking region portion 30 is disposed in the first electronic component groove 13, a second trigger 41 for sensing the frame rim 11 is disposed in the second electronic component groove 14. A socket 44 and a circuit board for signal stabilization are disposed in the socket groove 17 (not shown in FIGs). The circuits of the first trigger 40 and the second trigger 41 are connected to the socket 44 via the wireway slot 16. The first trigger 40 and the second trigger 41 output the vibration signal to a trigger module (not shown in FIGs) via the socket 44 and a signal wire (not shown in FIGs) connected thereto. The trigger module transforms the vibration signal into a simulated drum head sound or drum frame sound, and the simulated sounds are outputted by a sound box or earphones.

A locking hole 7 is disposed at the center of the lower surface of the second body member 5, to screw the second body member 5 on a drum holder (not shown in FIGs).

The fourth embodiment is combined with the jazz drum 50 or drum holder (not shown in FIGs) for use. The way of combining the electronic drum pad with the jazz drum is the same as the first embodiment, and the electronic drum pad is buckled with the drum frame of the jazz drum by the frame dike 21 of the second body member 5.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An electronic drum pad, comprising:

a base body, having a frame rim protruding upwardly at an edge part of an upper surface thereof, and having a frame dike protruding downwardly at an edge part of a lower surface thereof, the frame dike buckled and fastened on a drum frame of a jazz drum;

a striking region portion, arranged in a center of the base body;

a first trigger, configured for sensing vibration of the striking region portion, arranged inside a first electronic component groove of the base body, and located in a bottom part of the striking region portion; and a second trigger, configured for sensing vibration of the frame rim, arranged inside a second electronic component groove of the base body, the second electronic component groove being close to the frame rim.

2. The electronic drum pad of claim 1, wherein the base body is a structure made of rubber or silica gel material and formed integrally.

3. The electronic drum pad of claim 2, wherein the upper surface of the center of the base body is formed with a central recess, the striking region portion is disposed in the central recess, the first electronic component groove is formed on the bottom of the central recess.

4. The electronic drum pad of claim 3, wherein the second electronic component groove is provided with a sealing member for sealing the second trigger.

5. The electronic drum pad of claim 3, wherein the central recess is filled with the striking region portion, an upper surface of the striking region portion flushes with the upper surface of the base body.

6. The electronic drum pad of claim 1, wherein the strike region is a structure made of rubber or silica gel.

7. The electronic drum pad of claim 2, wherein a corner between the frame dike and the lower surface of the base body is provided with a reinforcing structure.

8. The electronic drum pad of claim 1, wherein the base body has at least one decorative groove at the upper surface thereof outside against the striking region portion, an LED lighting unit set and a circuit unit related to the LED lighting unit set are embedded in the at least one decorative groove, and the circuit unit is coupled with the first trigger.

9. The electronic drum pad of claim 8, wherein the at least one decorative groove is in a single annular shape surrounding the striking region portion.

10. The electronic drum pad of claim 8, wherein the decorative grooves are in concentric annular shapes surrounding the striking region portion.

11. The electronic drum pad of claim 8, wherein the at least one decorative groove is in a geometric shape.

12. The electronic drum pad of claim 1, further comprising an socket box fastened at a side edge of the base body, a socket disposed in the socket box, wherein the base body has a first wireway slot and a second wireway slot at the lower surface thereof, circuits of the first trigger and the second trigger are connected to the socket via the first wireway slot and the second wireway slot.

13. The electronic drum pad of claim 1, wherein the base body is formed by combining a first body member and a second body member by a plurality of screws.

14. The electronic drum pad according to claim 13, wherein the striking region portion is disposed at the center of the first body member, an edge part of an upper surface of the first body member being formed to be the frame rim.

15. The electronic drum pad according to claim 14, wherein the first electronic component groove is formed at a center of an upper surface of the second body member, and the second electronic component groove is formed on the upper surface of the second body member and close to the edge part of the upper surface of the second body member, the frame dike is formed on the edge part of a lower surface of the second body member.

16. The electronic drum pad according to claim 12, wherein the second body member has a socket groove at the upper surface thereof and close to the edge part of the upper surface thereof, a socket is disposed in the socket groove, and the socket groove and the first electronic component groove are communicated via the second wireway slot, and the circuits of the first trigger and the second trigger are connected to the socket via the first wireway slot and second wireway slot.

17. The electronic drum pad according to claim 13, wherein the second body member has a locking hole at the center of the lower surface thereof.

* * * * *